US005722861A

United States Patent [19]

Wetter

[11] Patent Number: 5,722,861

[45] Date of Patent: Mar. 3, 1998

[54] ELECTRICAL CONNECTOR WITH TERMINALS OF VARYING LENGTHS

[75] Inventor: James A. Wetter, Hoffman Estates, Ill.

[73] Assignee: Molex Incorporated, Lisle, Ill.

[21] Appl. No.: 608,355

[22] Filed: Feb. 28, 1996

[51] Int. Cl.[6] ..... H01R 13/502

[52] U.S. Cl. ..... 439/701; 29/884; 439/924.1

[58] Field of Search ..... 439/701, 924.1, 439/886, 884, 692, 693, 695, 848; 29/884, 885, 882, 883

[56] References Cited

U.S. PATENT DOCUMENTS

| | | | |
|---|---|---|---|
| 3,618,207 | 11/1971 | Sand et al. | 29/629 |
| 3,760,335 | 9/1973 | Roberts | 339/99 |
| 4,105,277 | 8/1978 | Jacobs | 439/848 |
| 4,197,636 | 4/1980 | Osanai | 29/882 |
| 4,337,574 | 7/1982 | Hughes et al. | 29/883 |
| 4,362,353 | 12/1982 | Cobaugh et al. | 29/882 |
| 4,418,971 | 12/1983 | Liss | 339/17 |
| 4,445,736 | 5/1984 | Hopkins | 339/17 |
| 4,628,597 | 12/1986 | Meehan et al. | 29/827 |
| 4,740,180 | 4/1988 | Harwath et al. | 439/848 |
| 4,795,602 | 1/1989 | Pretchel et al. | 264/272 |
| 4,854,041 | 8/1989 | Saito et al. | 29/883 |
| 4,889,495 | 12/1989 | Kimura | 439/60 |
| 5,009,614 | 4/1991 | Fogg et al. | 439/695 |
| 5,074,039 | 12/1991 | Hillbish et al. | 29/883 |
| 5,078,617 | 1/1992 | Gutierrez et al. | 439/422 |
| 5,080,613 | 1/1992 | Orui et al. | 439/660 |
| 5,085,601 | 2/1992 | Buchter et al. | 439/660 |
| 5,129,143 | 7/1992 | Wei et al. | 29/885 |
| 5,188,546 | 2/1993 | Ballard et al. | 439/885 |
| 5,201,883 | 4/1993 | Atoh et al. | 29/883 |
| 5,403,196 | 4/1995 | Northey et al. | 439/108 |
| 5,591,035 | 1/1997 | Burkholder et al. | 439/924.1 |

FOREIGN PATENT DOCUMENTS

| | | | |
|---|---|---|---|
| 8661-007A | 8/1985 | Australia | 43/16 |
| 374307 A1 | 6/1990 | European Pat. Off. | 23/68 |
| 590797 A2 | 4/1994 | European Pat. Off. | 13/642 |
| 62-14683 | 1/1987 | Japan | 23/68 |
| 63-133082 | 8/1988 | Japan | 23/68 |
| 1-235177 | 9/1989 | Japan | 43/20 |

*Primary Examiner*—P. Austin Bradley
*Assistant Examiner*—Yong Ki Kim
*Attorney, Agent, or Firm*—Charles S. Cohen

[57] ABSTRACT

An elongated electrical connector includes an elongated dielectric housing having a mating face and a longitudinal cavity defining a transverse insertion axis generally perpendicular to the mating face for receiving at least one terminal module. The terminal module includes a plurality of identically stamped terminals which are elongated in the direction of the insertion axis. The terminals having mating ends projecting from the housing beyond the mating face thereof. At least one of the identically stamped terminals has a bend therein to reduce the length thereof such that the mating end thereof projects from the housing a lesser distance beyond the mating face than the mating ends of the other terminals. A longitudinal dielectric insert is receivable in the cavity and is molded about portions of the identically stamped terminals.

18 Claims, 6 Drawing Sheets

ELECTRICAL CONNECTOR WITH TERMINALS OF VARYING LENGTHS

FIELD OF THE INVENTION

This invention generally relates to the art of electrical connectors and, particularly, to an electrical connector which includes a plurality of terminals of varying lengths such that at least one terminal mates with the respective mating terminals of a complementary mating connector in a different sequence from other terminals, and methods of manufacturing same.

BACKGROUND OF THE INVENTION

A typical input/output (I/O) electrical connector includes a dielectric housing having a front mating face and a rear face, with a terminal-receiving cavity means extending therebetween. A plurality of terminals are mounted in the cavity, with portions of the terminals, such as male pin portions, extending from the cavity outwardly of the dielectric housing for mating with the terminals of a complementary mating connector. Most often, the terminals have some form of body sections which are used to fix the terminals within the connector housing so that the projecting mating portions of the terminals are maintained in proper spacing and alignment.

In other connectors of this type, a plurality of terminal modules are inserted into the housing cavity, with each module including a dielectric insert or strip surrounding a plurality of the terminals. The dielectric insert may be overmolded about the body sections of the plurality of terminals. For instance, the dielectric housing of the connector may be elongated with a longitudinal cavity, and thin elongated terminal modules may be positioned in a side-by-side or "stacked" array within the housing cavity. Various latch means hold the modules within the cavity, and the overmolded dielectric inserts function to properly space and align the projecting mating portions of the terminals.

Such known I/O electrical connectors have become widely used because, in part, the plurality of terminals can be fabricated in a rapid, inexpensive stamping operation wherein all of the terminals are identical in size, shape or form. The identical terminals are easily and efficiently inserted into the connector housing either as individual terminals or by means of the terminal modules having the terminals embedded in the dielectric inserts. However, problems are encountered when it is desirable or necessary to have one or more of the terminals in the connector mate in a different sequence with its complementary terminal of the mating connector.

For instance, in a computer application, the majority of the terminals in such an I/O connector would be signal terminals, with a few (possibly one) of the terminals being a power terminal. It is desirable to have all of the signal circuits completed and running before completion of the power circuit. In order to accomplish this functional sequence, the power terminal conventionally is made shorter than the signal terminals so that the mating ends of the signal terminals project further from the connector housing than the power terminal and, accordingly, the signal terminals will mate with their complementary mating terminals before mating of the power terminal. However, fabricating the terminals in different sizes or lengths defeats all of the advantages afforded by progressively fabricating all of the terminals of the connector in identical configurations, as mentioned above. For example, the customized dies necessary for fabricating such different terminals are complex and expensive. Another approach is to manufacture a plurality of identical terminals and insert one or more of them a different distance into the housing than others. This procedure is also complex and expensive.

These problems further are magnified in connector applications wherein it is desirable or necessary to selectively plate a portion of the terminals, such as the mating ends or contact tips of the terminals. When all of the terminals are identical in size and shape, the mating ends or contact tips of the terminals can easily be selectively plated with precise uniformity because the tips of the terminals typically are stamped in a continuous linear path. However, if one or more of the terminals have varying lengths, the advantage of the selective plating process is defeated or at least reduced. For example, plating all of the terminals to depth that is sufficient to cover even the retracted terminals wastes precious metal plating materials. Alternatively, plating steps can be used, but this also is inefficient and costly.

The present invention is directed to solving the above myriad of problems in an electrical connector wherein all of the terminals of the connector can be fabricated in identical configurations and still allow for one or more of the terminals to be of varying lengths and, further, allowing the use of conventional, efficient plating processes.

SUMMARY OF THE INVENTION

An object, therefore, of the invention is to provide a new and improved electrical connector of the character described, wherein one or more of the terminals allow for sequential mating of some of the terminals of the connector, along with methods of manufacturing the connector.

In the exemplary embodiment of the invention, an elongated dielectric housing has a mating face and a longitudinal cavity defining a transverse insertion axis generally perpendicular to the mating face for receiving at least one terminal module. At least one terminal module is received in the cavity and includes a plurality of identically stamped terminals which are elongated in the direction of the insertion axis. The terminals have mating ends projecting from the housing beyond said mating face. At least one of the identically stamped terminals has a bend therein to reduce its length such that the mating end thereof projects from the housing a lesser distance beyond the mating face than the mating ends of the other terminals. A longitudinal dielectric insert is receivable in the housing cavity, and the dielectric insert is molded about portions of the terminals.

As disclosed herein, the plurality of elongated terminals are stamped of conductive sheet metal material. The mating ends of the terminals are generally planar, with distal tips of the terminals being twisted out of the planes of the respective mating ends to define contact portions of the terminals. The contact portions are selectively plated with a metal material different from the base metal of the terminals. In an alternative embodiment, the at least one terminal includes a double bend, with bent portions disposed on opposite sides of the plane of the sheet metal material of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
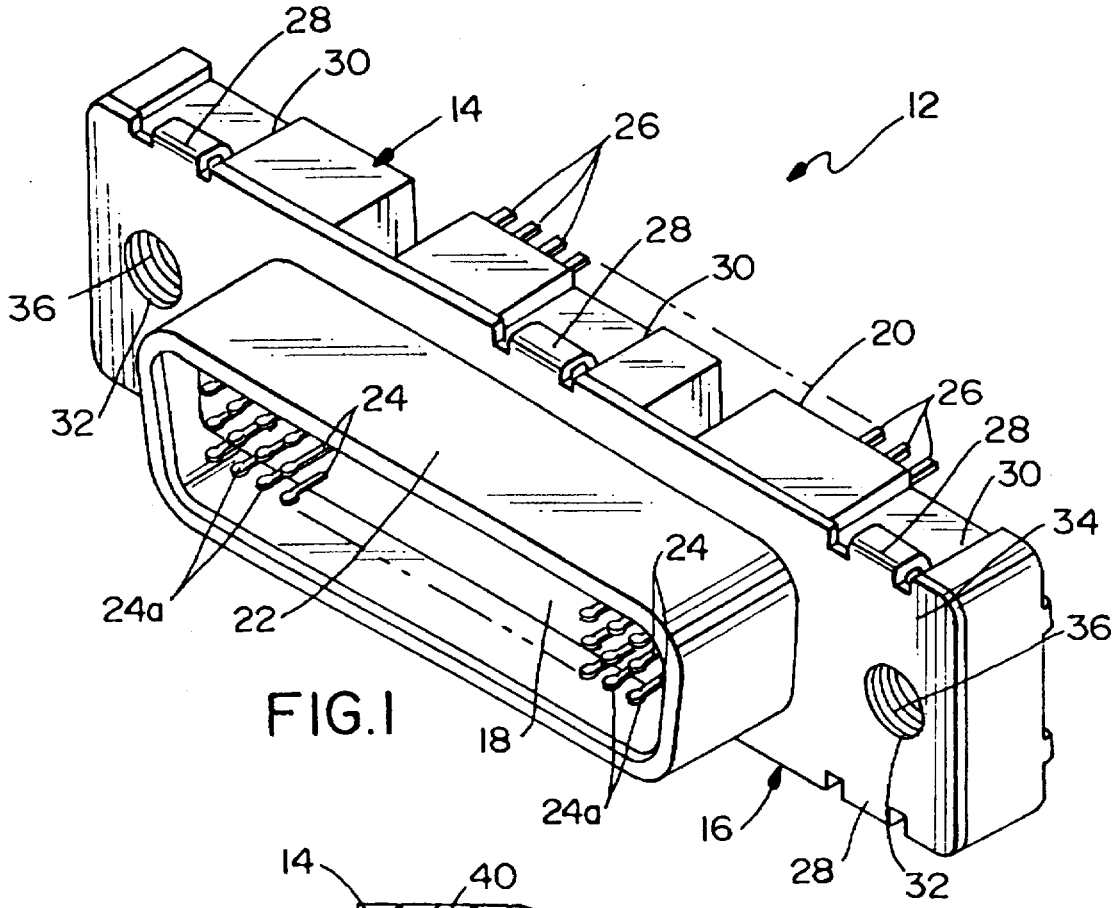
FIG. 1 is a perspective view of an electrical connector embodying the concepts of the invention.
Figure 3:
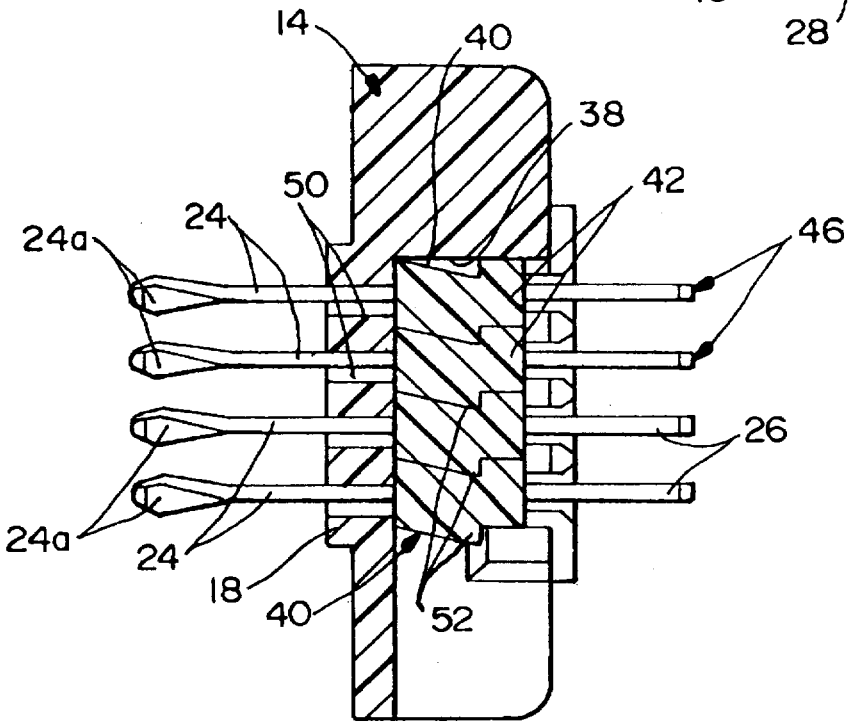
FIG. 3 is a vertical section through the connector housing having a plurality of the terminal modules mounted therein.
Figure 2:
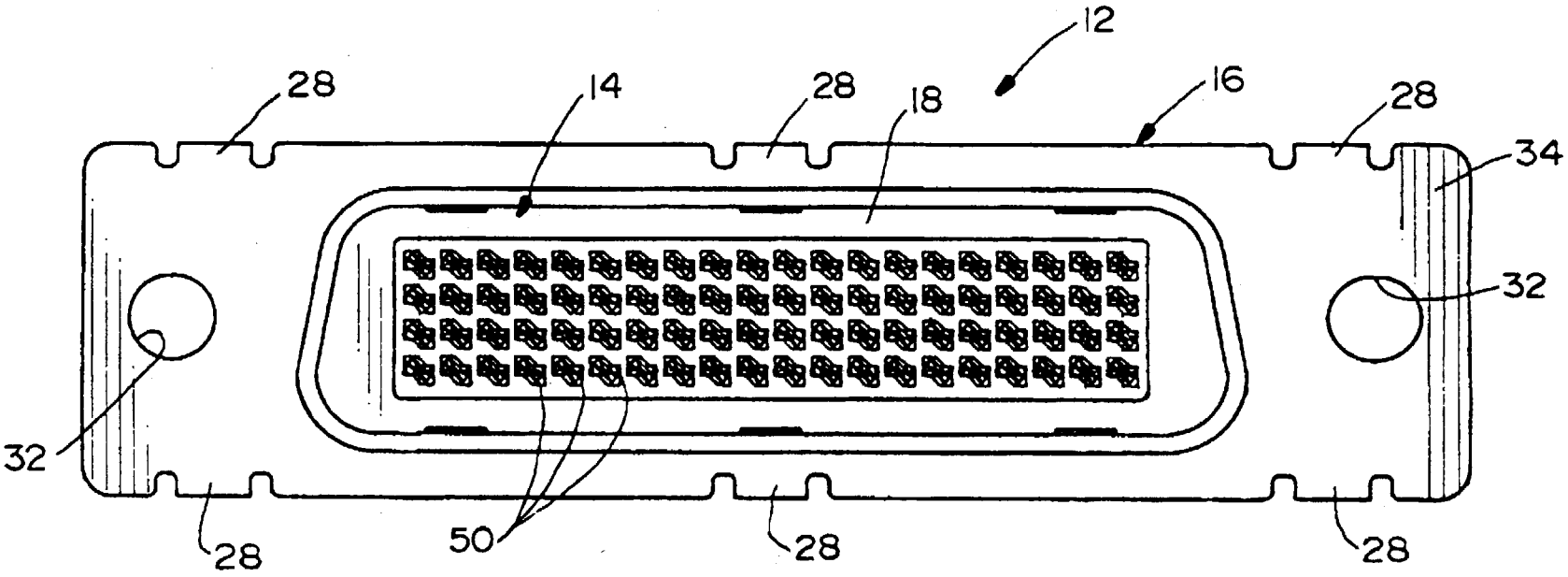
FIG. 2 is a front elevational view of the connector.

Referring to the drawings in greater detail, and first to FIGS. 1–3, the invention is embodied in an input/output (I/O) electrical connector, generally designated 12, which includes an elongated dielectric housing, generally designated 14, and a front shield, generally designated 16. Housing 14 is a one-piece structure unitarily molded of dielectric material such as plastic or the like. Shield 16 is a one-piece structure stamped and formed of sheet metal material.

Housing 14 has a front mating face 18 and a rear terminating face 20. Shield 16 has a front portion formed by a D-shaped shroud 22 surrounding forwardly projecting mating portions 24 of a plurality of terminals (described hereinafter) projecting forwardly of housing 14 beyond front mating face 18 thereof. Tail portions 26 of the terminals project from rear face 20 of the connector for insertion into appropriate holes in a printed circuit board for connection to circuit traces on the board and/or in the holes. Of course, the housing can have a variety of shapes, configurations and dimensions, and likewise the terminal can have a variety of other terminating portions or ends, other than tail portions 26.

As best in FIG. 1, a plurality of rearwardly formed tabs 28 of shield 16 embrace housing 14 within recesses 30 thereof. Lastly, a pair of holes 32 in a base plate 34 of shield 16 are aligned with a pair of internally threaded holes 36 in housing 14 for receiving appropriate threaded fasteners for fastening the connector to a printed circuit board and/or to a complementary mating connector.

Figure 4:
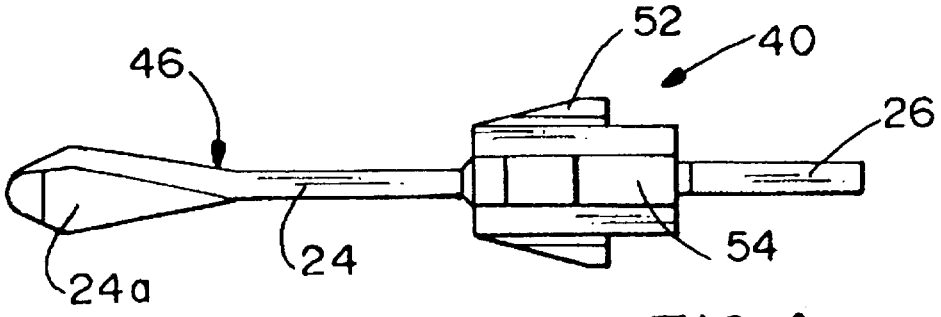
FIG. 4 is an end elevational view of one of the terminal modules.
Figure 5:
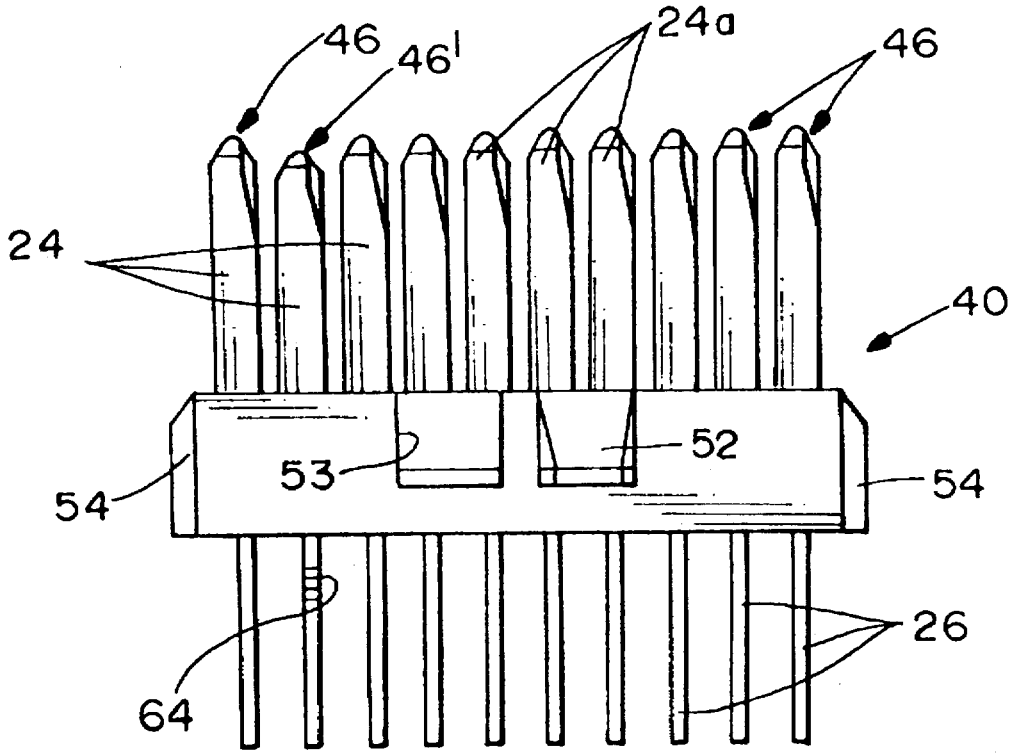
FIG. 5 is a side elevational view of one of the terminal modules.

Referring to FIGS. 4 and 5 in conjunction with FIGS. 1–3, and particularly FIG. 3, housing 14 of connector 12 includes a longitudinal cavity 38 for receiving a plurality of terminal modules, generally designated 40, in a stacked array of modules within the cavity. Each module includes a one-piece longitudinal dielectric insert 42 which is overmolded about the body or base sections 44 (FIG. 6) of a plurality of terminals, generally designated 46. Each terminal includes a blade-like forwardly projecting mating end in the form of a male portion 24 and a rearwardly projecting tail portion 26 extending from opposite ends of body section 44. As best seen in FIG. 3, mating portions 24 of the terminals extend into and through a plurality of apertures or passages 50 in housing 14 and outwardly of the passages beyond front mating face 18 of the housing. Tail portions 26 project outwardly of housing cavity 38 beyond rear terminating face 20 of the housing. Lastly, as best seen in FIGS. 3–5, the mating ends 24 of the terminals terminate in distal tips or contact portions **24*a*** which are preferably twisted out of the plane of the mating ends and the remainder of the terminals.

Terminal modules 40 are interengaged in their stacked array within housing cavity 38. In particular, as best shown in FIG. 5, a pair of latch projections 52 project outwardly from the opposite sides of dielectric inserts 42 of the modules into complementary recesses 53 in the opposite sides of the inserts of adjacent modules. In addition, a pair of outwardly projecting positioning ribs 54 (FIGS. 4 and 5) project from the opposite ends of the elongated modules for positioning into appropriate grooves (not shown) in the housing at opposite ends of elongated cavity 38.

Figure 6:
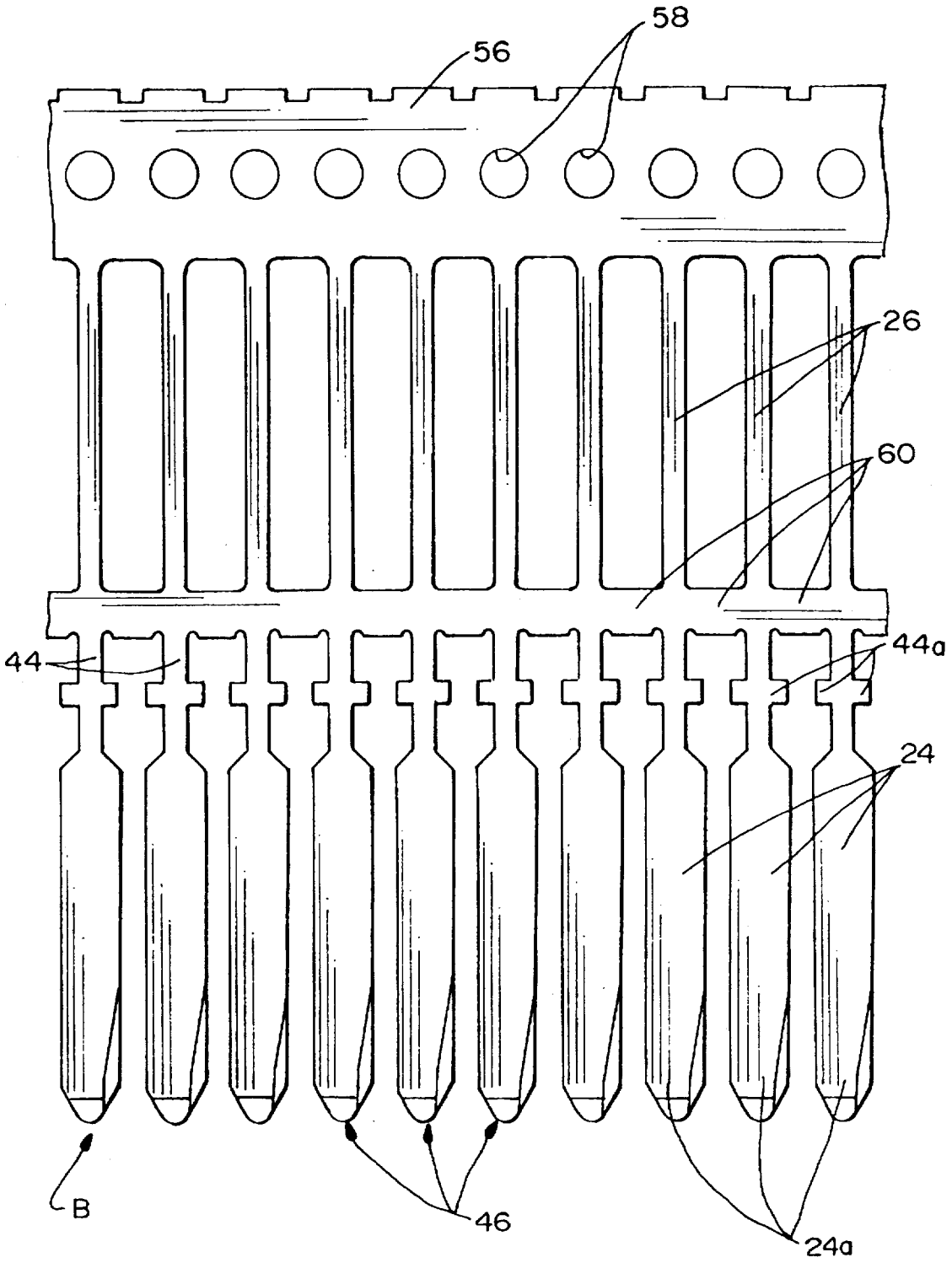
FIG. 6 is a plan view of a series of terminals in a "blank" of sheet metal material.

FIGS. 6–9 show the manner in which terminals 46 and terminal modules 40 are fabricated according to the concepts of the invention. Referring first to FIG. 6, a ribbon-type sheet of conductive metal material is fed through a progressive die to stamp and form a blank "B" as shown. Actually, the blank in FIG. 6 is a section of a continuous length of stamped and formed sheet metal material with a plurality of identically stamped terminals 46 joined at the distal ends of their tail portions 26 by a carrier strip 56 having conventional indexing holes 58 in a linear path therealong for incrementally indexing the sheet metal material through the processing machines. The mating ends or male portions 24 of the terminals are shown as already having been formed with the twisted distal tips to form contact portions **24*a*. It can be seen that body sections 44 of the terminals are joined lengthwise of the blank by webs 60. Outwardly projecting barbs 44*a* of body sections 44 facilitate subsequent holding of the terminals when embedded in dielectric inserts 42**.

Figure 7:
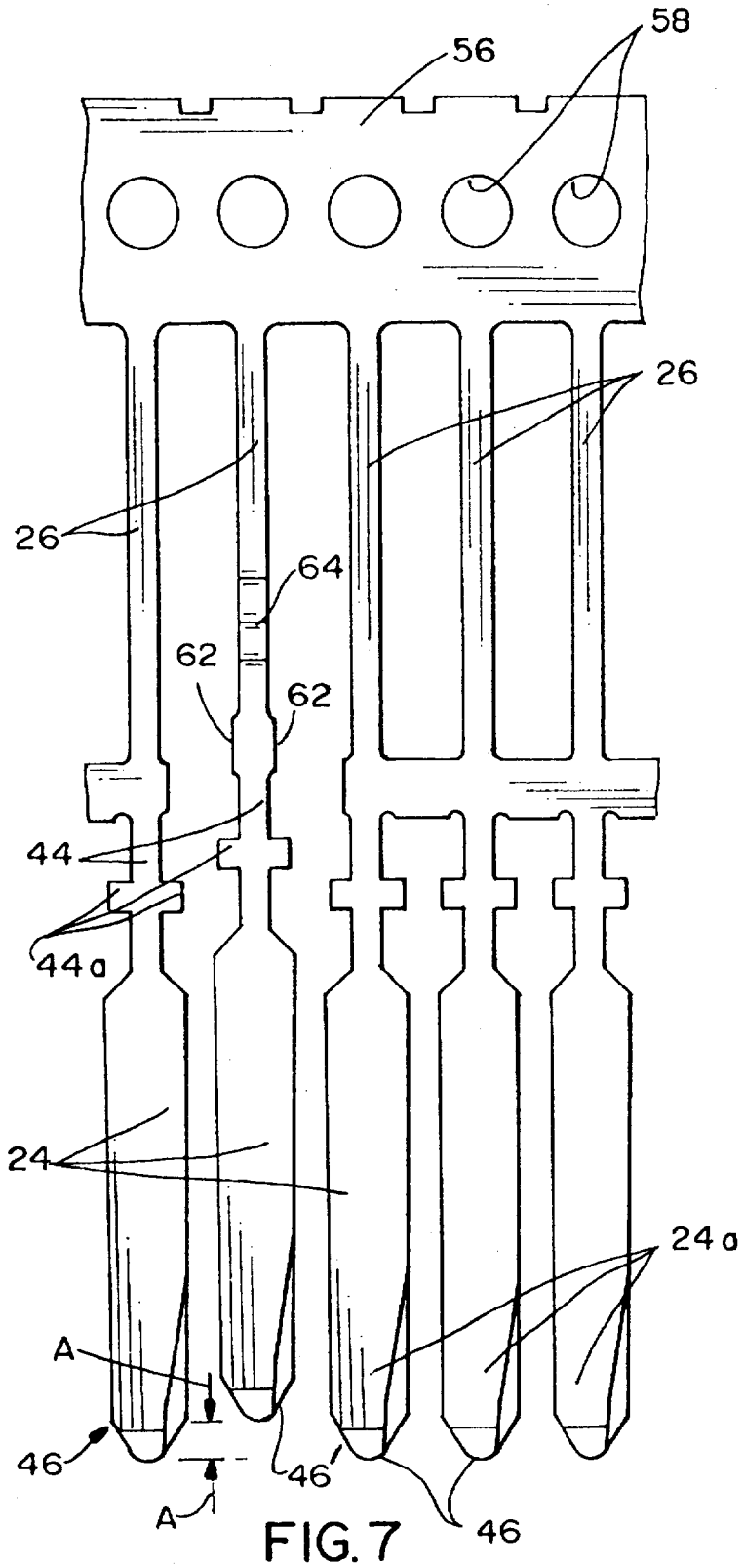
FIG. 7 is a plan view of a series of the stamped or blanked terminals with one of the terminals severed from its adjacent terminals and formed with a bend to shorten the length thereof.

Referring next to FIG. 7, it can be seen that one of the identically stamped terminals 46 shown in FIG. 6 has been made shorter and is generally designated 46' in FIG. 7. The shortening of terminal 46' is performed at a separate processing station whereat webs 60 on opposite sides of terminal 46' and its adjacent terminals are severed, as at 62. In addition, and/or simultaneously, the tail portion 26 of the one terminal 46' is deformed at 64 by forming a bend which is most clearly seen in FIG. 8. The deformation or bend is effective to shorten terminal 46' relative to the other identically stamped terminals 46 a distance denoted by the separation between arrows "A" in FIG. 7. For instance, this distance may be on the order 0.030 inch and it should be understood that the distance shown in FIG. 7 is not necessarily to scale relative to the typical other dimensions of such terminals. Otherwise, it can be seen that terminal 46' still is structurally identical to the other terminals 46 in that it includes a tail portion 26, a body section 44 including barbs **44*a*, a mating end or male portion 24 and a twisted distal end or contact portion 24*a*. The only difference is that terminal 46' is shorter than terminals 46 due to the deformation or bend 64**.

If it is desirable to selectively plate portions, such as contact portions **24*a*, of terminals 46 and 46'**, with a metal material different from the base metal of the terminals, the invention contemplates that the plating process be performed after the stamping and forming process shown in FIG. 6 but before separating and shortening terminal 46' as shown in FIG. 7. In other words, as seen in FIG. 6, contact portions 24a of all of the terminals still are in a line or linear array lengthwise of blank "B". This linear array of the selectively plateable portions simplifies the plating process. Webs 60 hold all of the terminals, including terminal 46', from separating or moving during the plating process. After plating, terminal 46' can easily be separated, deformed and shortened as shown in FIG. 7 with its contact portion 24a pre-plated.

Figure 9:
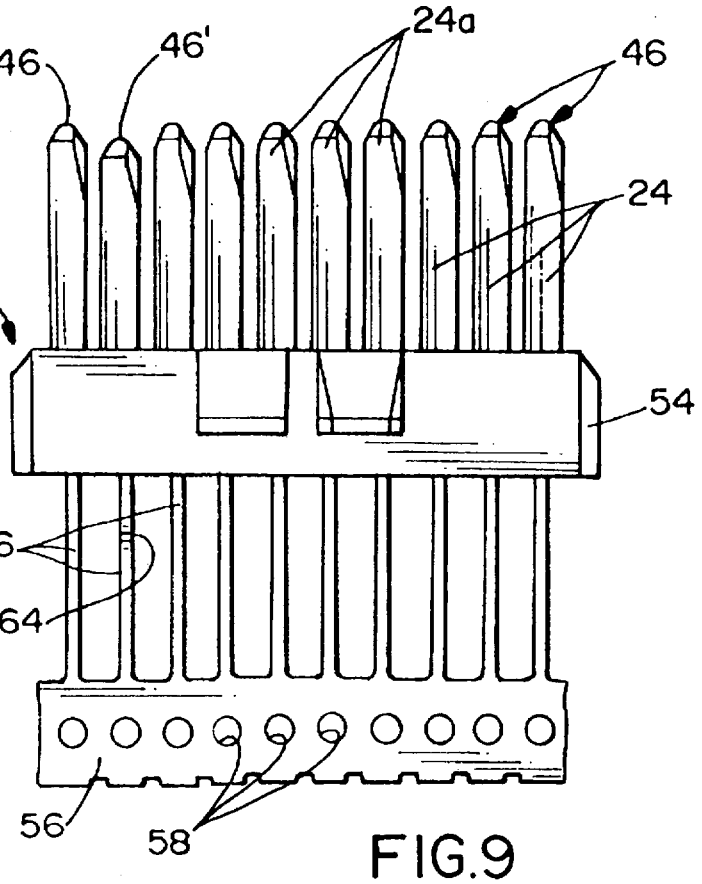
FIG. 9 is a view similar to that of FIG. 5, prior to the terminals being cut from the carrier strip.

FIG. 9 shows terminals 46 and 46' still attached to carrier strip 56 by means of the tail portions 26 of the terminals. This strip of terminals then can be positioned in a mold as a unit and dielectric insert 42 can be insert molded about the body sections of the terminals and including bend 64 in the shortened terminal 46'. After the dielectric insert is overmolded about portions of the terminals, webs 60 are severed and carrier strip 56 is removed by severing tail portions 26 to form one of the terminal modules 40 as shown in FIGS. 3–5. Webs 60 hold terminals 46 against relative movement during the molding process.

Figure 8:
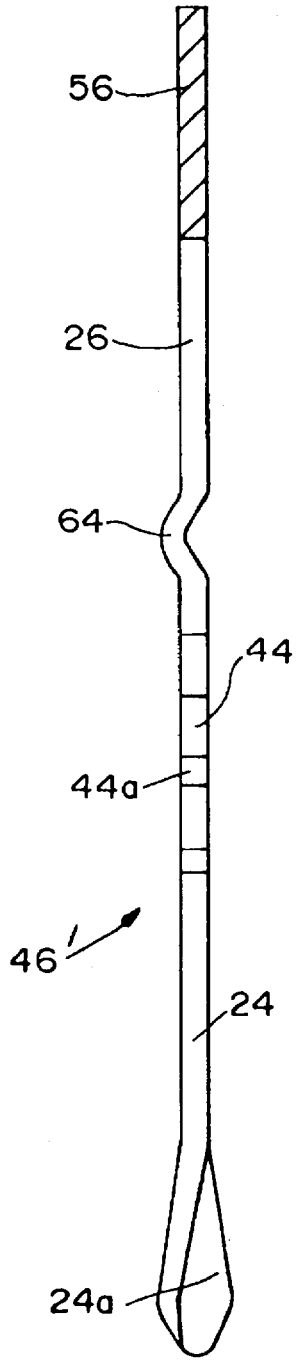
FIG. 8 is a side elevational view of the formed terminal still attached to the carrier strip.
Figure 10:
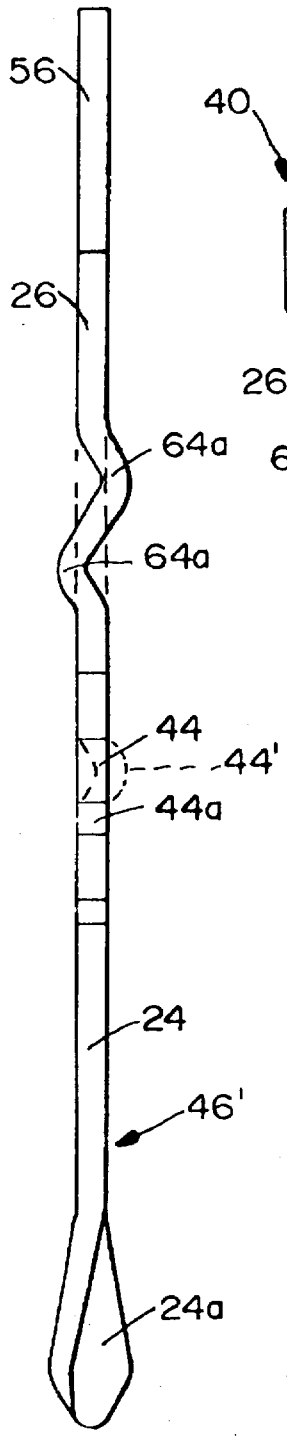
FIG. 10 is a view similar to that of FIG. 8, but showing alternative bending schemes for shortening a terminal.

If it is desirable to shorten one of the terminals a greater extent than that shown in FIGS. 7 and 8, reference is made to FIG. 10 wherein it can be seen that a double bend is formed in the terminal to provide two bent portions 64a on opposite sides of the plane of the terminal. In this manner, the terminal can be shortened twice the amount as shown in FIG. 7 without having the bent portion(s) of the terminal bulge too far to one side of the terminal.

Moreover, it can be appreciated that the deformation which provides the shortened terminal can be located elsewhere on a terminal. For example, the deformation may instead be formed at location 44 as shown in FIG. 10 in phantom by bend 44'. A benefit to providing the bend this location (or any location on the contact side of web 60) is that the web 60 need not be severed adjacent the shortened terminal prior to the bending operation. Finally, as is evident from FIG. 10, if desired there may be multiple bends at separate locations along a given terminal, e.g., at both 64a and 44'. In the alternative, bend 64 shown in FIGS. 5, 7 and 8 could be located on tail 26 close enough to carrier strip 56 such that bend 64 is cut from the tail upon severing the carrier strip.

Figure 11:
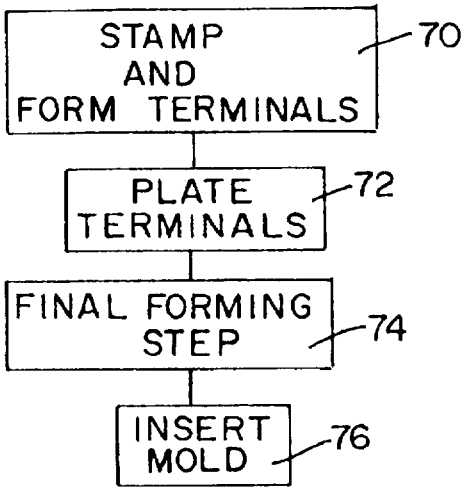
FIG. 11 is a flow diagram representative of a method of fabricating the terminal modules.

FIG. 11 shows a schematic block diagram summarizing the method of fabricating one of the terminal modules as described above. The first step 70 of stamping and forming the terminals corresponds to the depiction of FIG. 6 and described above in regard thereto. In other words, blank "B" (FIG. 6) is stamped to create identical terminals 46, and contact portions 24a are formed or twisted out of mating ends 24 of the terminals. The next step 72 in FIG. 11 corresponds to the above description of selectively plating contact portions 24a of the terminals before the one terminal 46' is shortened. The next step 74 in FIG. 11 representing the final forming of the terminals, actually refers to FIG. 7 and the above description in regard thereto. In other words, the final forming step comprises severing webs 60 (if necessary) at opposite sides of terminal 46', as at 62, and bending the tail portion 26 of terminal 46', as at 64, to shorten the terminal a given distance, e.g., the distance represented by arrows "A," in relation to the remainder of the terminals 46. The final step 76 shown in FIG. 11 corresponds to FIG. 9 and the above description in regard thereto. In other words, dielectric insert 46 is insert molded about the terminals to form one of the terminal modules 40. Of course, thereafter, carrier strip 56 is severed from tail portions 26 of the terminals as described above.

The resulting terminal module then is insertable into cavity 38 (FIG. 3) along with the other terminal modules 40. When the connector is fully assembled, the mating end 24 of shortened terminal 46' will project from housing 14 a lesser distance beyond mating face 18 than the mating ends of the other terminals 46. In other words, contact portions 24a of terminals 46 will make engagement with their mating terminals of the complementary mating connector before contact portion 24a of shortened terminal 46'.

Lastly, although it has been shown and described herein that one of the terminals 46' of one of the terminal modules 40 is shortened relative to the remainder of the terminals in that module, it should be understood that the invention contemplates that more than one terminal in any given module can be shortened, and/or terminals in more than one module can be shortened, depending upon the electrical specifications of the connector. Moreover, terminals can be formed to any number of lengths in a module or array of modules, for example, to three distinct lengths to provide for three-stage mating of a connector. In addition, the number of terminals in any given module can vary as can be seen by comparing the width of the connector shown in FIG. 1 with the width of the module shown in FIGS. 5 and 9. Still further, it should be understood that the method of providing identically stamped and formed terminals with varying lengths is applicable in connectors which do not use terminal modules. In other words, the concepts of the invention are equally applicable for connectors wherein the terminals are inserted into passages in the connector housing separately and independently from being mounted within the housing as part of terminal modules including dielectric inserts.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a dielectric housing having a mating face and a cavity having a transverse insertion axis generally perpendicular to the mating face; and at least one terminal module including a plurality of elongated stamped terminals which have identical mating ends, said terminal module having a dielectric insert molded about portions of said stamped terminals and being disposed in said cavity such that said terminals are elongated in the direction of said insertion axis and said mating ends are proximate said mating face; and at least one of said stamped terminals having a longitudinal axis and having been bent to form bent portions projecting from opposite sides of the longitudinal axis thereof so as to alter the shape thereof such that the mating end thereof is further from said mating face than the mating end of at least one of the other of said terminals.

2. A terminal module for use in an electrical connector, comprising:

a plurality of generally parallel, elongated stamped terminals, each terminal having an identical mating end;

a dielectric insert molded about portions of said terminals with the mating ends of the terminals projecting from said dielectric insert; and at least one of said stamped terminals having a longitudinal axis and having been bent to form bent portions projecting from opposite sides of the longitudinal axis thereof to thereby alter the shape thereof such that the mating end thereof projects from the dielectric insert a lesser distance than the mating end of at least one of the other of said terminals.

3. A method of fabricating a plurality of terminals for an electrical connector, comprising the steps of:

stamping a plurality of identical elongated terminals from conductive sheet metal material with the terminals joined at proximal ends thereof to a carrier strip and with opposite distal ends of the terminals defining contact portions thereof, each of said contact portions being spaced a first distance from said carrier strip, plating said contact portions at the distal ends of the terminals with a metal material different from said sheet metal material of the terminals, and deforming at least one of said identical terminals to reduce the spacing between the distal end thereof and said carrier strip to a second distance such that said distal end of said at least one of said terminals projects from the carrier strip a lesser distance than the distal end of at least one of the other of said terminals.

4. The method of claim 3, further including the step of molding a dielectric housing component about portions of said terminals after said deforming step.

5. The method of claim 3 wherein said deforming step comprises forming a bend in said at least one of the identical terminals.

6. The method of claim 3 wherein said at least one of said identical terminals has a longitudinal axis and said deforming step comprises forming a double bend in said at least one of the identical terminals such that bent portions thereby formed project from opposite sides of the longitudinal axis thereof.

7. A method of fabricating a plurality of terminals for an electrical connector, comprising the steps of:

stamping a plurality of identical terminals from conductive sheet metal material with the terminals being joined by web portions of the sheet metal material and with end portions of the terminals defining an array of aligned contact portions having contact ends thereof in a common plane, plating said aligned contact portions with a metal material different from the sheet metal material of the terminals, severing any web portion joined to at least one of said identical terminals, deforming at least one but not all of the identical terminals to alter the shape thereof whereby the contact end of the contact portion of said at least one of the terminals is shifted relative to said common plane, and molding a dielectric housing component about portions of said terminals.

8. The method of claim 7 wherein said deforming step comprises forming a bend in said at least one of the identical terminals.

9. The method of claim 7 wherein said at least one of said identical terminals has a longitudinal axis and said deforming step comprises forming a double bend in said at least one of the identical terminals such that bent portions thereby formed protect from opposite sides of the longitudinal axis thereof.

10. A method of fabricating a terminal module for use in an electrical connector, comprising the steps of:

stamping a plurality of identical terminals from conductive sheet metal material with the terminals being joined by web portions of the sheet metal material and with end portions of the terminals defining contact portions thereof, severing any web portion joined to at least one of said identical terminals, deforming said at least one of the identical terminals to alter the share thereof, molding a dielectric insert about portions of the terminals leaving said web portions exposed and with the end portion of said at least one terminal projecting from the insert a lesser distance than the end portions of the other of said terminals, and severing the web portions remaining between any of the terminals.

11. The method of claim 10 wherein said deforming step comprises forming a bend in said at least one of the identical terminals.

12. The method of claim 10 wherein said at least one of said identical terminals includes a longitudinal axis and said deforming step comprises forming a double bend in said at least one of the identical terminals such that bent portions thereby formed project from opposite sides of the longitudinal axis thereof.

13. The method of claim 10 further including the step of severing the web portions between at least one of said identical terminals and its adjacent terminals, between said stamping and deforming steps.

14. An electrical connector, comprising:

a dielectric housing having a mating face and a cavity having a transverse insertion axis generally perpendicular to the mating face; and at least one terminal module disposed in said cavity, said at least one terminal module including a plurality of stamped terminals and a dielectric insert, each terminal having an identical mating end and being elongated in the direction of said insertion axis, said dielectric insert encasing a mid-section of said stamped terminals, and at least one of said stamped terminals having been bent to alter the shape thereof such that the mating end thereof projects from the dielectric insert a lesser distance than the mating end of at least one other of said terminals, said dielectric insert being spaced from a portion of said terminal that has been bent.

15. An electrical connector, comprising:

a dielectric housing having a mating face and a cavity having a transverse insertion axis generally perpendicular to the mating face; and at least one terminal module disposed in said cavity, said at least one terminal module including a plurality of stamped terminals and a dielectric insert, each terminal having an identical mating end and being elongated in the direction of said insertion axis, said dielectric insert encasing a mid-section of said stamped terminals, and at least one of said stamped terminals having a longitudinal axis and having been bent to form bent portions projecting from opposite sides of the longitudinal axis thereof to alter the shape thereof such that the mating end thereof projects from the dielectric insert a lesser distance than the mating end of at least one other of said terminals.

16. A terminal module for use in an electrical connector, comprising:

a plurality of generally parallel, elongated stamped terminals, each terminal having an identical mating end;

a dielectric insert molded about portions of said terminals with the mating ends of the terminals projecting from said dielectric insert; and at least one of said stamped terminals having been bent to thereby alter the shape thereof such that the mating end thereof projects from said dielectric insert a lesser distance than the mating end of at least one of the other of said terminals and wherein said dielectric insert is spaced from a portion of said terminal that has been bent.

17. The method of claim 8, wherein said step of molding includes molding said dielectric insert about said bend.

18. The method of claim 8, wherein said step of molding includes molding said dielectric insert spaced from said bend.

* * * * *